US005626063A

United States Patent [19]

Kosbab

[11] Patent Number: 5,626,063

[45] Date of Patent: May 6, 1997

[54] TOOL FOR UNLOCKING A FIFTH WHEEL LOCKING HANDLE

[76] Inventor: Delbert D. Kosbab, 305 19th N. St., New Ulm, Minn. 56073

[21] Appl. No.: 598,342

[22] Filed: Feb. 8, 1996

[51] Int. Cl.[6] ..... B66F 15/00; B25B 2/16

[52] U.S. Cl. ..... 81/488; 81/177.1; 7/166; 7/100; 254/131

[58] Field of Search ..... 81/488, 15.9, 177.1, 81/177.2, 177.5, 124.7; 7/100, 166–170; 254/21, 113, 117, 120, 131, 133 R

[56] References Cited

U.S. PATENT DOCUMENTS

| | | | |
|---|---|---|---|
| 1,512,559 | 10/1924 | Moore | 81/177.7 X |
| 2,278,111 | 3/1942 | Kleinpell | 81/15.9 |
| 2,895,364 | 7/1959 | Heinz | 81/177.1 |
| 3,738,768 | 6/1973 | Kuhn | 81/177.85 X |
| 3,840,211 | 10/1974 | Castor | 254/131 |
| 3,953,048 | 4/1976 | Vincent et al. | 254/131 X |
| 4,685,164 | 8/1987 | Sebalos | 7/100 X |

*Primary Examiner*—D. S. Meislin
*Attorney, Agent, or Firm*—Herman H. Bains

[57] ABSTRACT

A tool for shifting the locking bar of a fifth wheel of a tractor from a locked position to an unlocked position includes an elongate handle having a U-shaped locking handle engaging member. The handle includes a straight portion, an offset portion, and a terminal portion having the U-shaped member affixed to its outer end. The U-shaped member engages the locking handle in overlying relation and the terminal portion underlies and engages the offset portion of the locking handle whereby when the tool is rotated, the locking handle will be shifted to the unlocked position.

1 Claim, 1 Drawing Sheet

TOOL FOR UNLOCKING A FIFTH WHEEL LOCKING HANDLE

BACKGROUND OF THE INVENTION

This invention relates to a tool for shifting the locking handle of the fifth wheel coupling from a locked position to an unlocked position.

DISCUSSION OF PRIOR ART PROBLEMS

Trailers are releasably locked to the fifth wheel coupling of a tractor by shifting a locking handle from an unlocked position to the locked position. Conversely, trailers are released from the tractor when the fifth wheel locking handle is shifted from the locked to the unlocked position to disengage the locking elements of the fifth wheel from the coupling pin of the trailer. The locking handle on many fifth wheels has an L-shaped or similar angularly offset configuration. Access to the fifth wheel locking handle when the trailer is coupled to the tractor is difficult at best. An operator must extend his arm in order to reach the locking handle of the fifth wheel coupling. This extension of the user's arm and manipulation of the handle sometimes results in back injury or pulled muscles. Further, this effort sometimes results in dirty or torn clothing. The present invention permits easy access and ready manipulation of the fifth wheel locking handle from the locked to the released position.

SUMMARY OF THE INVENTION

An object of this invention is to provide a novel tool for readily shifting the fifth wheel locking handle of a tractor from the locked to the unlocked position to release the trailer from coupled relation with respect to the tractor.

The novel tool is of elongate one piece construction including a handle comprised of an elongate straight portion, an offset portion and a terminal portion. A hand grip element is secured to the straight portion and a U-shaped member is secured to the terminal portion of the handle. During use of the tool, the U-shaped member embraces and engages the handle while the terminal portion underlies and engages the offset portion of the fifth wheel locking handle. The novel tool is of a length to project beyond the sides of the trailer when the tool is in engaging relation with the fifth wheel locking handle. A user may simply rotate the tool about its longitudinal axis and readily shift the fifth wheel locking handle from the locked position to the unlocked position to free the trailer from coupled relation with respect to the tractor.

DESCRIPTION OF THE PREFERRED EMBODIMENT

Figure 1:
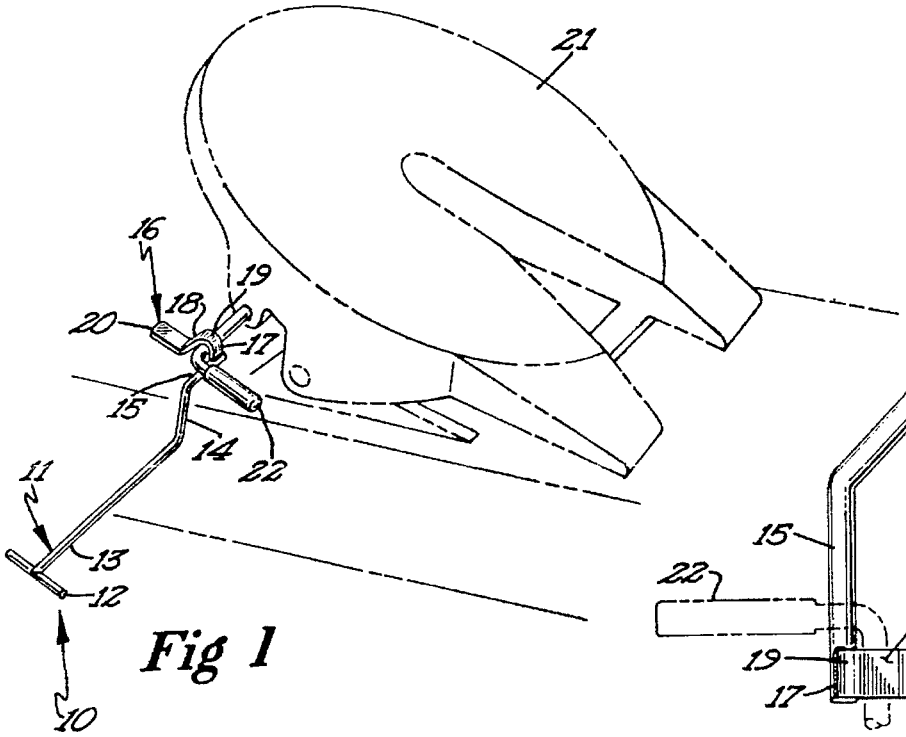
FIG. 1 is a perspective view of the novel tool illustrated in engaging operative relation with the locking handle of a fifth wheel, the fifth wheel being illustrated by dotted line configuration.

Referring now to the drawings and more specifically to FIG. 1, it will be seen that one embodiment of the novel tool, designated generally by the reference numeral 10, is thereshown. The tool 10 is formed of a suitable rigid metal and includes an elongate handle 11 comprised of an elongate straight portion 13 having a hand grip element 12 rigidly attached to one end thereof. An elongate offset portion 14 is integrally formed with the other end of the straight portion 13 and projects angularly therefrom. An elongate terminal portion 15 is integrally formed with the offset portion and projects angularly from the latter. In the embodiment shown, the straight portion 13 and the terminal portion 15 is integrally formed with the offset portion and projects angularly from the latter. In the embodiment shown, the straight portion 13 and the terminal portion are disposed in substantially parallel relations. It will also be noted that the major length of the tool 10 consists of the straight portion 13 of the handle 11.

Figure 4:
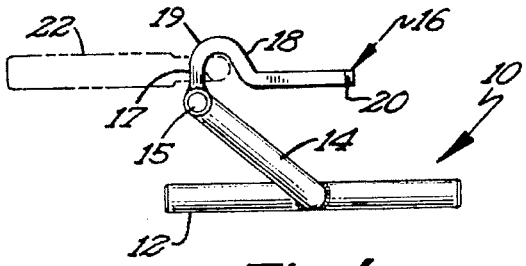
Figure 2:
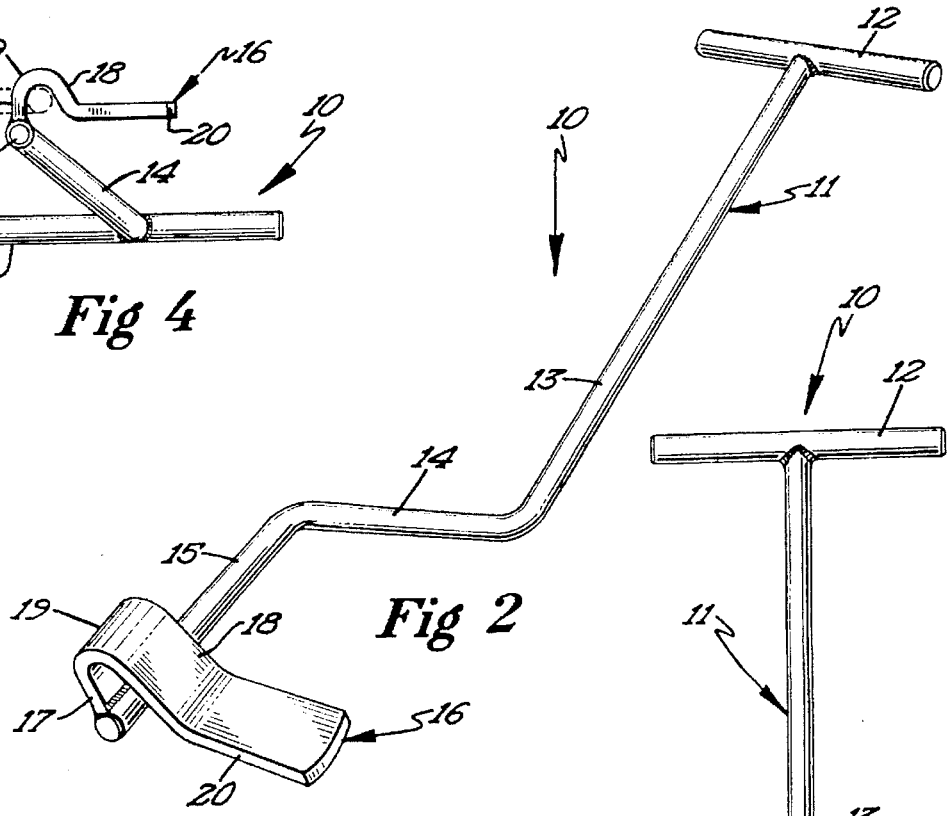
FIG. 2 is an enlarged perspective view of the novel tool.
Figure 3:
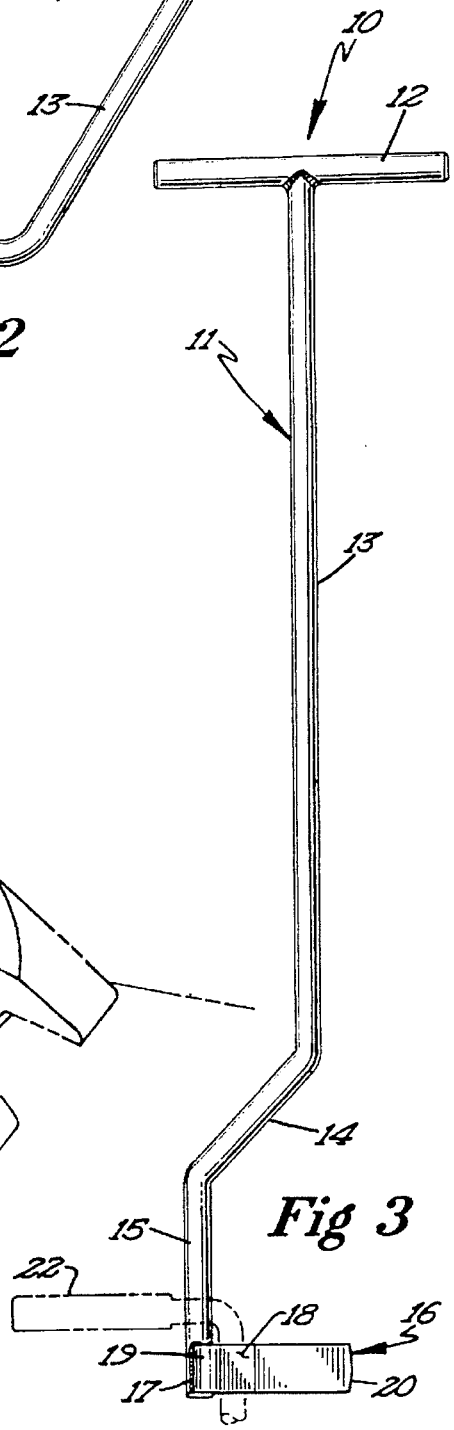
FIG. 3 is an elevational view of the novel tool with a portion of the fifth wheel locking handle illustrated in phantom line configuration and showing the relationship of the tool with respect to the locking handle; and, FIG. 4 is an end elevational view of the novel tool with the fifth wheel locking handle illustrated in phantom line configuration.

It will also be noted that the terminal portion 15 has a length dimension slightly greater than the length dimension of the offset portion 14. A fifth wheel U-shaped handle engaging member 16 is rigidly secured to the outer end of the terminal portion and the U-shaped member 16 includes a leg 17 and a leg 18 interconnected by a bight portion 19. Referring now to FIGS. 2 and 4, it will be seen that the U-shaped member 16 is slightly unsymmetrical because of the diverging angular relation of the leg 18 with respect to the leg 17. The leg 18 of the U-shaped member 16 has a tab portion 20 integrally formed therewith and projecting outwardly therefrom.

The tool 10 is designed to engage the locking handle 22 of a conventional fifth wheel coupler 21 and permit a user to shift the locking handle from the locked to the unlocked positions. It will be noted that the locking handle 22 is of L-shaped configuration and when shifted between locked and unlocked positions causes shifting movement of the locking elements of the fifth wheel 21 between locking and release positions. In this regard, the trailer (not shown) has a vertically disposed coupling pin which engage in the slot in the fifth wheel and is locked thereto by the locking elements (not shown) when the locking handle is shifted to the locked position.

During use of the novel tool 10, the trailer will be coupled to the tractor by the trailer coupling pin and fifth wheel coupling device 21. The locking handle 22 will be in the locked position as illustrated in FIG. 1. The user will manipulate the tool 10 so that the U-shaped member overlies, embraces and engages the fifth wheel locking handle 22. The terminal portion 15 of the tool will then underlie and engage the offset portion **22*a*** of the locking handle. When the tool is rotated by the user about its longitudinal axis, the tool will shift the locking handle in a corresponding rotating action from the locked position to the unlocked position. The tool will then be disengaged from the fifth wheel locking handle and the trailer will be released from coupled relation with respect to the tractor.

The unsymmetrical configuration of the U-shaped members permits this U-shaped member to accommodate locking handles of different sizes. The tool permits ready access to the locking handle and minimizes any tendency of injury by a user in unlocking the trailer from coupled relation with respect to the fifth wheel. When manually unlocking the fifth wheel locking handle, the user would normally reach under the trailer and over the dual wheels to gain access to the locking handle. The user has to reach a substantial distance to access the locking handle and manually manipulating the locking handle may result in injury to the user or damage to the user's clothes. The use of the novel tool eliminates these problems and permits ready and easy release of the trailer from the tractor.

The tab portion 20 is also used in releasing frozen brakes. The tab 20 engages the brake shoe while the terminal portion of the handle will bear against the drum to permit freeing of the brake shoe when the handle is turned. Because of the unique angled construction of the tool, the tab will fit between the drum and brake shoe without regard to the particular angle presented when attempting to free the brakes. When the tab element is wedged between the brake shoe and drum, rotation of the handle will pry the frozen brake shoe from the drum. Thus the tool eliminates the need for manually pounding or banging the brakes to free the brake shoe from the drum.

From the foregoing description, it will be seen that I have provided a simple but unique tool for readily shifting the fifth wheel locking handle from the locked to the unlocked position. It will further be seen that my novel tool has further utility in readily freeing frozen brake shoes from locked frozen relation with respect to brake drum.

Thus it will be seen that I have provided a novel tool which is not only of simple and efficient construction, but one which functions in a more efficient way than any heretofore known comparable tool.

What is claimed is:

1. A tool for use in shifting the locking handle of a fifth wheel device for a tractor from the locked position to the unlocked position for releasing a trailer from coupled relation with respect to the tractor, the locking handle having an offset outer end, said tool comprising, an elongate rigid handle including an elongate straight portion, a handle grip element secured to one end of said straight portion, an elongate offset portion integral with straight said portion and extending angularly therefrom, an elongate terminal portion integral with said offset portion and extending angularly therefrom, said terminal portion being disposed in substantially parallel relation to said straight portion, a generally U-shaped member rigidly connected with the end of said terminal portion and extending angularly therefrom, said U-shaped member embracing and engaging a fifth wheel locking handle when the terminal portion is disposed in engaging and underlying relation with the offset end of the fifth wheel locking handle whereby when the tool is rotated about its longitudinal axis, the fifth wheel locking handle will be shifted from the locked position to the unlocked position, and a tab element integral with said U-shaped member and extending therefrom, and being disposed substantially parallel with said hand grip element, said tab being adapted to wedge between the brake shoe and brake drum of a vehicle for freeing a frozen brake shoe from the drum when the tool is rotated about its longitudinal axis, and said hand grip element being of elongate straight configuration and disposed normal to the straight portion to define a T-type gripping handle.

* * * * *